United States Patent [19]

Meade et al.

[11] Patent Number: 4,920,693

[45] Date of Patent: May 1, 1990

[54] FLOWER POT

[76] Inventors: Phyllis Meade, 809 8th Ave., Largo, Fla. 34640; George Spector, 233 Broadway #3815, New York City, N.Y. 10007

[21] Appl. No.: 417,899

[22] Filed: Oct. 5, 1989

[51] Int. Cl.[5] ..... A47G 7/00

[52] U.S. Cl. ..... 47/41.12

[58] Field of Search ..... 47/33, 41.12, 68, 72; 248/27.8, 915; 52/DIG. 9

[56] References Cited

U.S. PATENT DOCUMENTS 767,175 8/1904 Sibole ..... 47/72

FOREIGN PATENT DOCUMENTS 2375818 9/1978 France ..... 47/68

*Primary Examiner*—David A. Scherbel
*Assistant Examiner*—Michele A. Van Patten

[57] ABSTRACT

A flower pot for decorative artificial flowers is provided and consists of a styrofoam block sized to be placed into open ends of a pair of cans so that the cans will abut each other with cutout slots in each can in alignment with each other. Adhesive tape is applied for securing the open ends of the cans to each other while a small tube is placed into side wall of one can for fluid drainage therefrom. The cans are coated to simulate a log so that the decorative artificial flowers can be inserted through the cutout slots and into the styrofoam block to offer a new novel and decorative external appearance. Three simulated logs can be utilized to form a decorative triangular log configuration in which they may be adjustable to each other for changing the height of the flower pot.

5 Claims, 1 Drawing Sheet

FLOWER POT

BACKGROUND OF THE INVENTION

The instant invention relates generally to planters and more specifically it relates to a flower pot for decorative artificial flowers.

There are available conventional planters of various designs but which do not provide the novel improved functions and structure of the invention herein disclosed.

SUMMARY OF THE INVENTION

A primary object of the present invention is to provide a flower pot for decorative artificial flowers that will overcome the shortcomings of the prior art devices.

Another object is to provide a flower pot for decorative artificial flowers offering a new novel and decorative external appearance.

An additional object is to provide a flower pot for decorative artificial flowers being a three log configuration in which the logs may be adjustable to each other for changing its shape.

A further object is to provide a flower pot for decorative artificial flowers that is simple and easy to use.

A still further object is to provide a flower pot for decorative artificial flowers that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
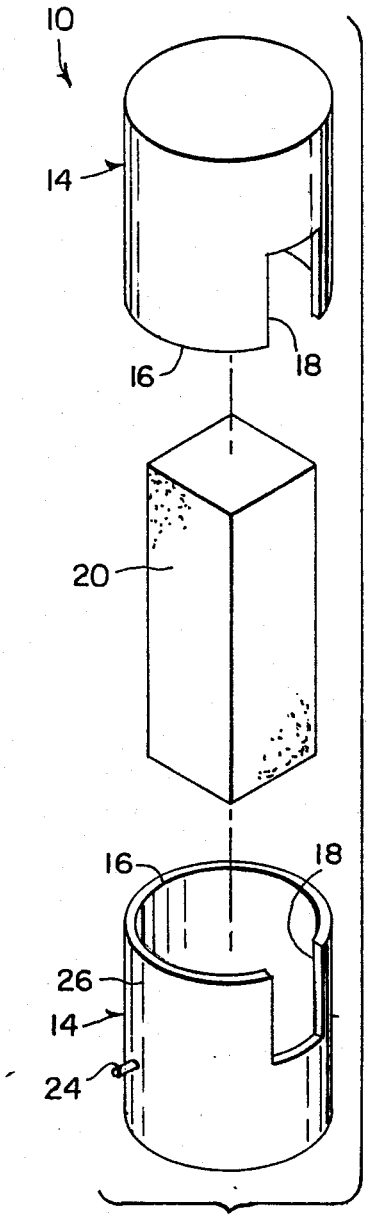
FIG. 1 is an exploded perspective view showing how the invention is constructed.
Figure 2:
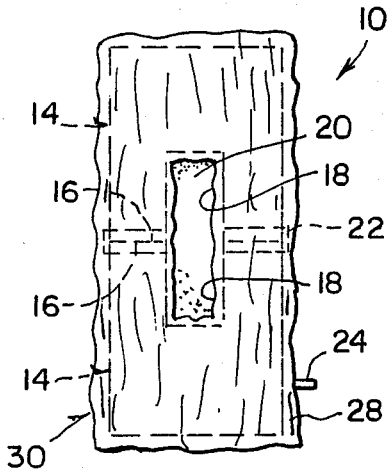
FIG. 2 is a top view of one of the logs in a finished state.

Turning now descriptively to the drawings, in which similar reference characters denote similar elements throughout the several views. FIGS. 1 and 2 illustrate a flower pot 10 for decorative artificial flowers 12 consisting of a pair of cans 14, each having an open end 16 with a cutout slot 18 extending therefrom. A styrofoam block 20 is sized to be placed into the open end 16 of each of the cans 14 so that the cans will abut each other with the cutout slots 18 in alignment with each other. Adhesive tape 22 is used for securing the open ends 16 of the cans 14 to each other. A small tube 24 is placed into side wall 26 of one of the cans 14 for fluid drainage therefrom. A coating 28 is applied to the cans 14 to simulate a log 30 so that the decorative artificial flowers 12 can be inserted through the cutout slots 18 and into the styrofoam block 20 to offer a new novel and decorative external appearance.

The coating 28 includes four parts plaster of paris, one part joint cement of portland and lime and three parts water all mixed together and applied onto the cans 14 with groove-like impressions to dry. A wood color paint and a waterproof finish is applied thereto being of a clear spar urethane spray.

Figure 3:
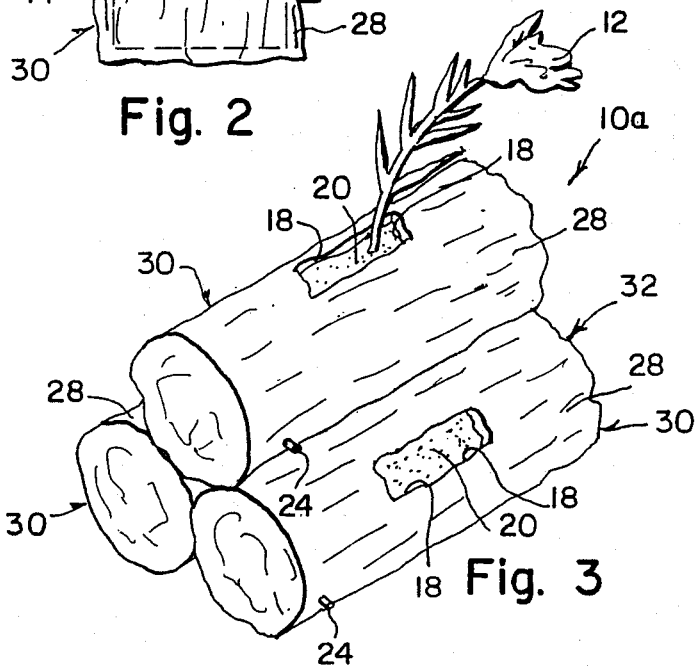
FIG. 3 is a perspective view of the invention completely finished and assembled in a three log configuration.

The flower pot **10*a*, shown in FIG. 3, is three simulated logs 30 attached to each other to form a decorative triangular log configuration 32**.

Figure 4:
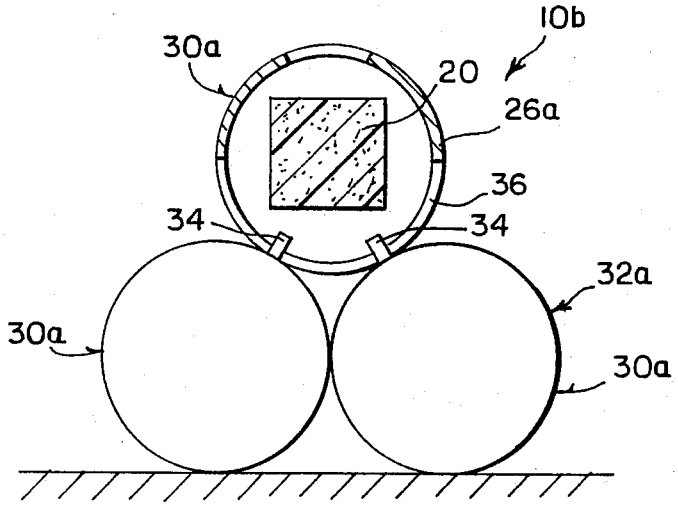
FIG. 4 is an end view partly in section of a modification whereby the three logs are adjustable to each other.

FIG. 4 shows a decorative triangular log configuration **32*a* that is adjustable and includes the two bottom simulated logs 30*a* each having at least one pin 34 extending radially therefrom. The upper simulated log 30*a* has at least one annular slot 36 about side wall 26*a* thereof to receive the pins 34 from the two bottom simulated logs 30*a* so that the pins 34 can slide within the annular slot 36 to change height of the flower pot 10*b***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flower pot for decorative artificial flowers comprising:

(a) a pair of cans, each having an open end with a cutout slot extending therefrom;

(b) a styrofoam block sized to be placed into the open end of each of said cans so that said cans will abut each other with said cutout slots in alignment with each other;

(c) adhesive tape for securing the open ends of said cans to each other;

(d) a small tube placed into side wall of one of said cans for fluid drainage therefrom; and (e) means for coating said cans to simulate a log so that the decorative artificial flowers can be inserted through the cutout slots and into said styrofoam block to offer a new novel and decorative external appearance.

2. A flower pot as recited in claim 1, wherein said coating means includes:

(a) four parts plaster of paris;

(b) one part joint cement of portland and lime; and (c) three parts water all mixed together and applied onto said cans with groove-like impressions to dry.

3. A flower pot as recited in claim 2, wherein said coating means further includes:

(a) a wood color paint applied thereto; and (b) a waterproof finish being of a clear spar urethane spray applied over said wood color paint.

4. A flower pot as recited in claim 3, further comprising three simulated logs attached to each other to form a decorative triangular log configuration.

5. A flower pot as recited in claim 4, wherein said decorative triangular log configuration is adjustable and includes:

(a) said two bottom simulated logs each having at least one pin extending radially therefrom; and (b) said upper simulated log having at least one annular slot about side wall thereof to receive said pins from said two bottom simulated logs so that said pins can slide within said annular slot to change height of said flower pot.

* * * * *